US010903021B1

(12) United States Patent
Vaishnavi et al.

(10) Patent No.: US 10,903,021 B1
(45) Date of Patent: Jan. 26, 2021

(54) MECHANISM TO OPERATE A SWITCH WITH A DOOR MOUNTED HANDLE

(71) Applicant: Eaton Intelligent Power Limited, Dublin (IE)

(72) Inventors: Romil Vaishnavi, Talab Tillo Jammu (IN); Prashant N. Savgave, Undri (IN)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 16/727,175

(22) Filed: Dec. 26, 2019

(51) Int. Cl.

| | |
|---|---|
| ***H01H 3/46*** | (2006.01) |
| ***H01H 3/04*** | (2006.01) |
| ***H01H 9/22*** | (2006.01) |
| ***H01H 19/60*** | (2006.01) |

(52) U.S. Cl.
CPC ..... *H01H 3/46* (2013.01); *H01H 3/04* (2013.01); *H01H 9/22* (2013.01); *H01H 19/60* (2013.01)

(58) Field of Classification Search
CPC .. H01H 3/04; H01H 3/46; H01H 3/06; H01H 3/10; H01H 2011/0025; H01H 9/22; H01H 19/635; H01H 19/60; G05G 1/04
See application file for complete search history.

(56) References Cited

U.S. PATENT DOCUMENTS 10,483,058 B2 * 11/2019 Vaishnavi ..... H01H 19/24

OTHER PUBLICATIONS

U.S. Appl. No. 16/270,875, "Electrical Switching Mechanism Control Apparatus", filed Feb. 8, 2019.

* cited by examiner

*Primary Examiner* — Vanessa Girardi
(74) *Attorney, Agent, or Firm* — Benesch, Friedlander, Coplan & Aronoff LLP

(57) ABSTRACT

A pole unit has an actuator shaft that is rotatable about a switch axis to switch the pole unit between open and closed conditions. A linkage is configured to rotate the actuator shaft in response to movement of the handle pivotally about the orthogonal axis. The linkage includes a panel configured to rotate the actuator shaft upon sliding movement of the panel. The linkage further includes links that are pivotally coupled in series between the handle and the panel to slide the panel in response to pivotal movement of the handle.

19 Claims, 4 Drawing Sheets

MECHANISM TO OPERATE A SWITCH WITH A DOOR MOUNTED HANDLE

TECHNICAL FIELD

This technology relates to an electrical switching mechanism including pole units having electrical contacts.

BACKGROUND

An electrical switch, such as a safety switch or disconnect, may be housed in a cabinet. The switch may include pole units having electrical contacts. A switching mechanism may be connected with the pole units to switch the pole units between open and closed conditions manually by the use of a handle at the exterior of the enclosure.

SUMMARY

A pole unit has an actuator shaft that is rotatable about a switch axis to switch the pole unit between open and closed conditions. A linkage is configured to rotate the actuator shaft in response to movement of the handle pivotally about the orthogonal axis. The linkage includes a panel configured to rotate the actuator shaft upon sliding movement of the panel. The linkage further includes links that are pivotally coupled in series between the handle and the panel to slide the panel in response to pivotal movement of the handle.

DETAILED DESCRIPTION

Figure 1:
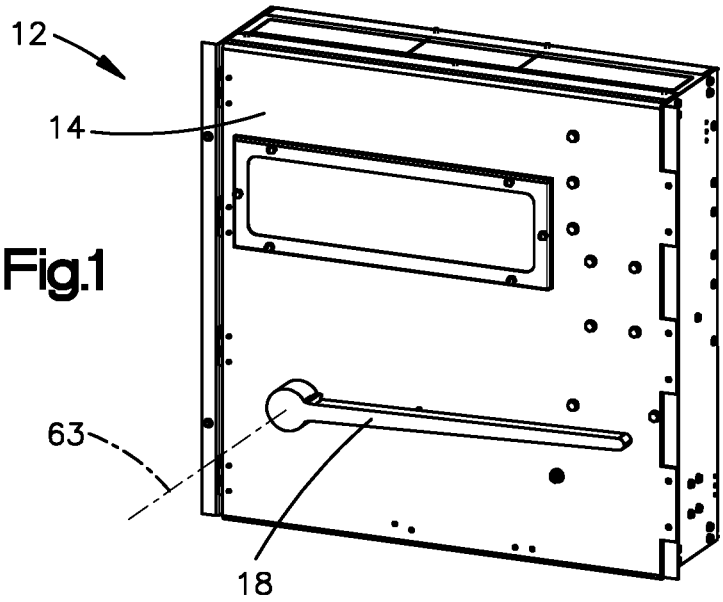
FIG. 1 is a front perspective view of an electrical cabinet containing a switching apparatus.

The apparatus illustrated in the drawings includes parts that are examples of the elements recited in the claims. The illustrated apparatus thus includes examples of how a person of ordinary skill in the art can make and use the claimed invention. They are described here to provide enablement and best mode without imposing limitations that are not recited in the claims. One or more of the elements of one embodiment may be used in combination with, or as a substitute for, one or more elements of another as needed for any particular implementation of the claimed invention.

As shown in FIG. 1, an apparatus 10 includes a cabinet 12 for electrical equipment. The cabinet 12 has a door 14. A manually operated handle 18 at the front side of the door 14 is connected with a switching assembly 20 (FIG. 2) inside the enclosure 12. The switching assembly 20 is switched between open and closed conditions by moving the handle 18 pivotally between open and closed positions.

The switching assembly 20 in the illustrated example includes a row of pole units 22. The pole units 22 are alike, and each individual pole unit 22 includes an assembly of electrical contacts that are switchable between open and closed conditions. Each pole unit 22 further includes an actuating shaft 26. Each actuating shaft 26 is linked with the electrical contacts in the respective pole unit 22 to shift the contacts between their open and closed conditions upon rotation of the shaft 26 between open and closed positions. The actuating shafts 26 are centered on a common switch axis 27 reaching horizontally across the inside of the cabinet 12, and are interconnected end-to-end throughout the row of pole units 22 so as to rotate together about the axis 27. The pole units 22 are thereby engaged with one another to be switched together such that all of the pole units 22 in the switching assembly 20 have the same condition, either open or closed, at any given time.

A linkage 30 is provided for rotating the actuator shafts 26 in response to movement of the handle 18. The linkage 30 includes a panel 40 that is supported for sliding movement vertically beside one end of the row of pole units 22. The linkage 30 also includes links 42, 44, 46, and 48. The links 42-48 are pivotally coupled in series between the handle 18 and the panel 40 to slide the panel 40 in response to pivotal movement of the handle 18.

Figure 2:
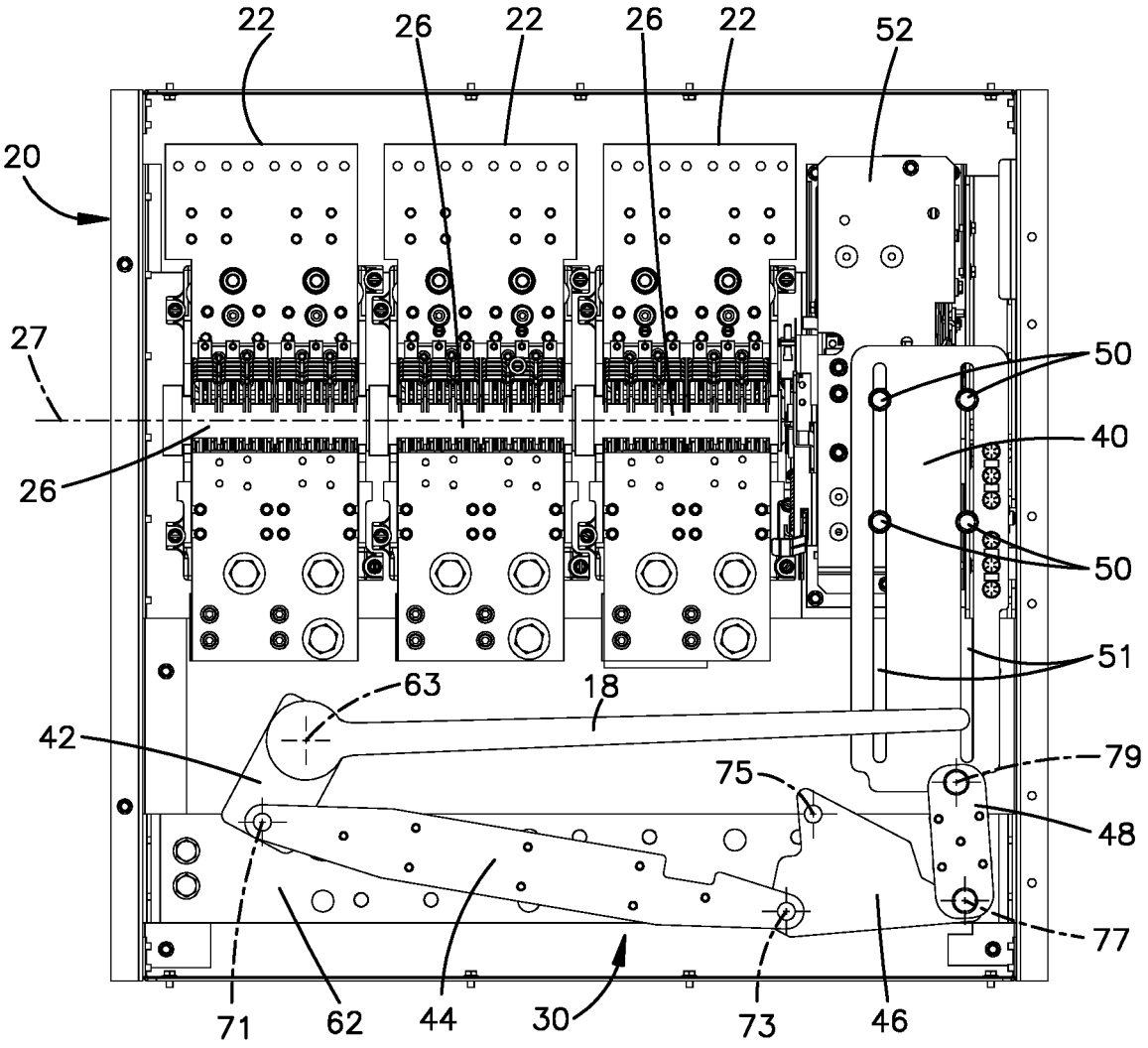
FIG. 2 is front view showing components contained within the cabinet.
Figure 3:
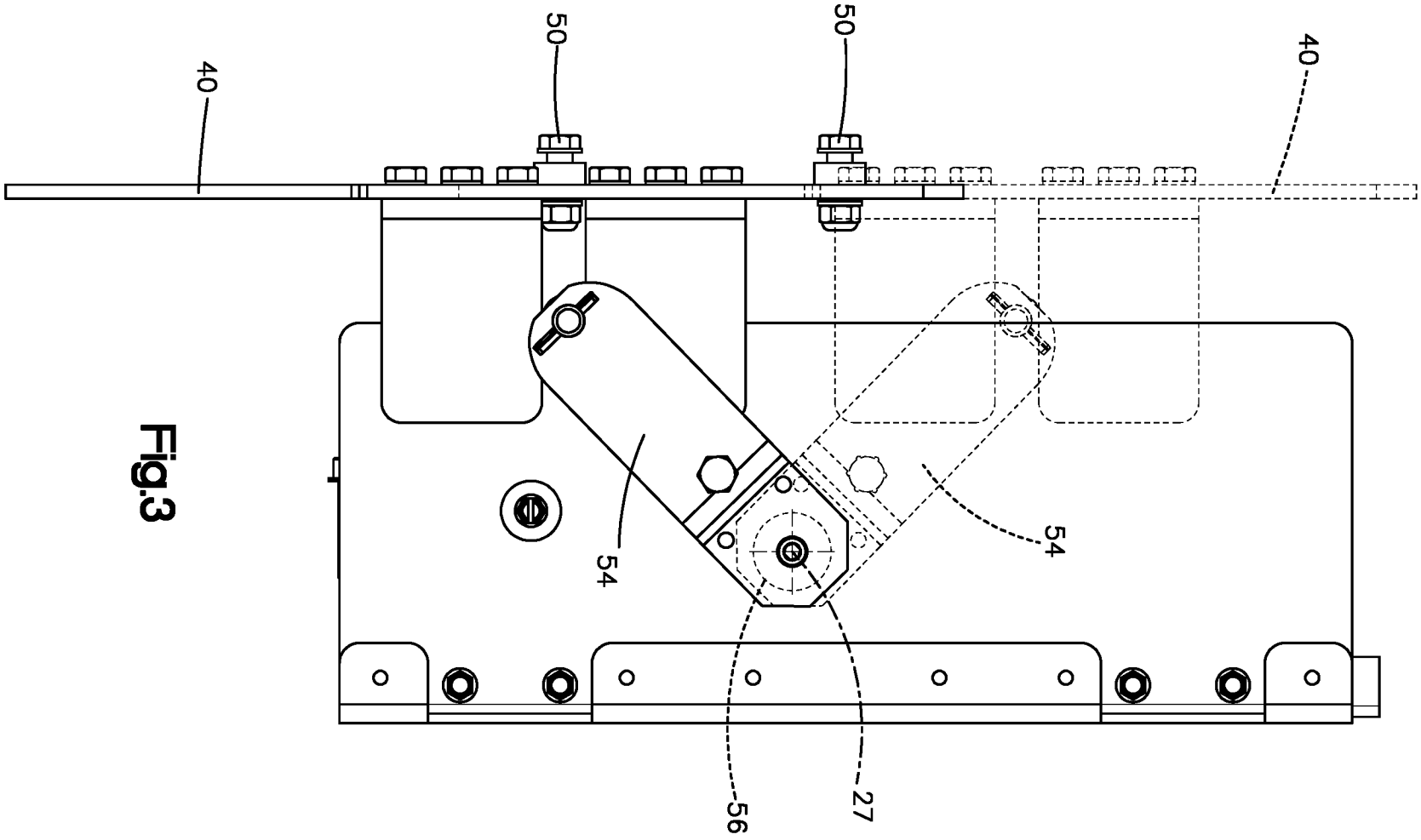
FIG. 3 is an enlarged partial side view of components shown in FIG. 2.

As shown in FIG. 2, guide pins 50 project through slots 51 in the panel 40 to support the panel 40 for sliding movement on a stationary frame 52. As shown in FIG. 3, a lever 54 interconnects the panel 40 with an actuator 56 supported for rotation about the switch axis 27. The actuator 56 is coupled with the actuator shafts 26 in the pole units 22. When the panel 40 moves vertically between the raised and lowered positions shown in FIG. 3, it pivots the lever 54 so as to rotate the actuator 56 and the shafts 26 between their open and closed positions.

A hub 60 (FIG. 4) is mounted for rotation on another stationary frame 62 inside the cabinet 12. The hub 60 defines an axis of rotation 63 for the handle 18. The axis 63 at the hub 60 is horizontal but is orthogonal to the switch axis 27. Although the hub 60 is rotatable about the axis 63 relative to the frame 62, the axis 63 is fixed relative to the frame 62.

Figure 4:
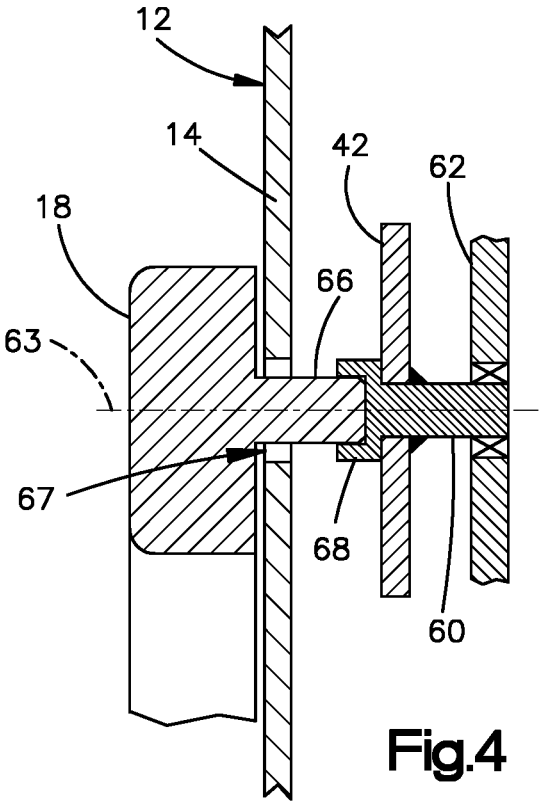
FIG. 4 is an enlarged partial side view of other components shown in FIG. 2.
Figure 5:
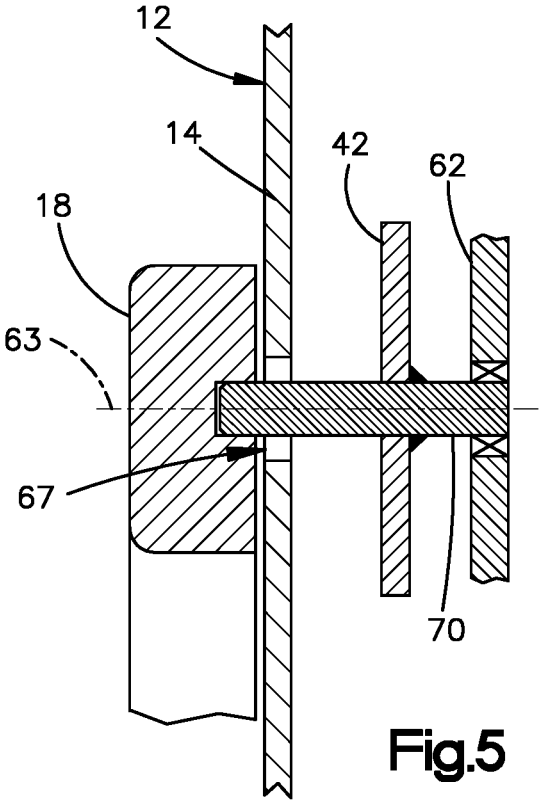
FIG. 5 is a view similar to FIG. 4, showing parts of an alternative embodiment.

In the embodiment of FIG. 4, the handle 18 has an extension 66 configured to project inward through an aperture 67 in the door 14 for coupling in a socket portion 68 of the hub 60. In the alternative embodiment of FIG. 5, a hub 70 is configured to project outward through the aperture 67 in the door 14 for coupling with the handle 18 in a similar manner. In each case, a user standing at the front of the cabinet 12 can couple the handle 18 with the hub 60 or 70 through the aperture 67, and can move the handle 18 pivotally about the axis 63 to operate the linkage 60 for switching the pole units 22 between their open closed conditions, without the need to reach to stand or reach at the side of the cabinet 10.

The first link 42 is fixed to the hub 60 so as to move pivotally about the hub axis 63 upon rotation of the hub 60. The second link 44 is coupled to the first link 42 and the third link 46 for movement pivotally about respective axes 71 and 73. Those axes 71 and 73 are both movable with the second link 44 relative to the frame 62. The third link 46 is mounted on the frame 62 for movement pivotally about another axis 75 that is fixed relative to the frame 62. The fourth link 48 is coupled to the third link 46 and the panel 40 for movement pivotally about respective 77 and 79 axes that are both movable relative to the frame 62.

Figure 6:
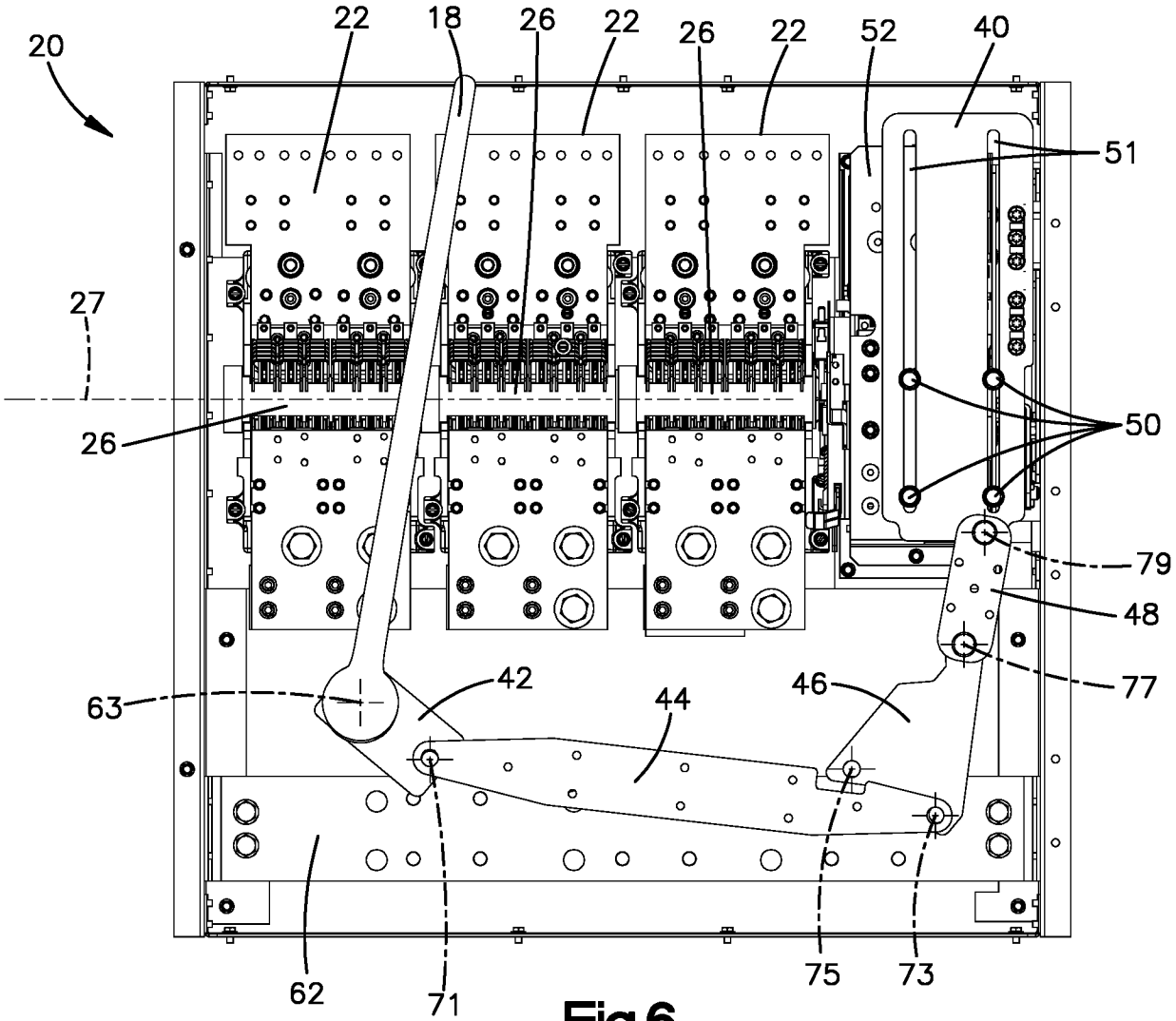
FIG. 6 is a view similar to FIG. 2, showing parts in different positions.

When the handle 18 is in the position of FIG. 2, the switching assembly 20 has an open condition. As the handle 18 is moved from the position of FIG. 2 toward the position of FIG. 6, such movement of the handle 18 drives the hub 60 to rotate in the counterclockwise direction as viewed in the drawings. This drives the first link 42 to push the second link 44 from right to left relative to the frame 62. The second link 44 then drives the third link 46 to pivot in a counter-clockwise direction about the fixed axis 75 on the frame 62. Such movement of the third link 46 pushes the fourth link 48 upward, which lifts the panel 40 upward toward the raised position. As the panel 40 moves into the raised position, it pivots the lever 46 to rotate the actuator shafts 26 fully to the positions in which they close the contacts in the pole units 22. The reverse process of moving the handle 18 back to the position of FIG. 2 drives the linkage 30 to switch the pole units 22 back to the open conditions.

This written description sets for the best mode of carrying out the invention, and describes the invention so as to enable a person of ordinary skill in the art to make and use the invention, by presenting examples of the elements recited in the claims. The detailed descriptions of those elements do not impose limitations that are not recited in the claims, either literally or under the doctrine of equivalents.

What is claimed is:

1. An apparatus comprising:

a cabinet;

a frame in the cabinet;

a pole unit in the cabinet, including an actuator shaft that is rotatable about a switch axis to switch the pole unit between open and closed conditions;

a hub mounted on the frame for rotation about an axis that is orthogonal to the switch axis and fixed relative to the frame;

a handle configured to rotate the hub;

a panel configured to rotate the actuator shaft upon sliding movement of the panel;

a first link fixed to the hub;

a second link pivotally coupled to the first link;

a third link pivotally coupled to the second link;

a fourth link pivotally coupled to the third link and the panel.

2. An apparatus as defined in claim 1, wherein the second link is coupled to the first link and the third link for movement pivotally about respective axes that are movable relative to the frame.

3. An apparatus as defined in claim 1, wherein the third link is mounted on the frame for movement pivotally about an axis that is fixed relative to the frame.

4. An apparatus as defined in claim 1, wherein the fourth link is coupled to the third link and the panel for movement pivotally about respective axes that are movable relative to the frame.

5. An apparatus as defined in claim 1, wherein the cabinet has a door, and the handle is configured to rotate the hub about the orthogonal axis when the door is closed.

6. An apparatus as defined in claim 5, wherein the door has an aperture, and the handle is configured for releasable rotational coupling with the hub through the aperture in the door so as to rotate the hub about the orthogonal axis when the door is closed.

7. An apparatus comprising:

a cabinet;

a pole unit installed in the cabinet, including an actuator shaft that is rotatable about a switch axis to switch the pole unit between open and closed conditions;

a handle configured for movement pivotally about an axis orthogonal to the switch axis; and a linkage configured to rotate the actuator shaft in response to movement of the handle pivotally about the orthogonal axis, including a panel configured to rotate the actuator shaft upon sliding movement of the panel, and links pivotally coupled in series between the handle and the panel to slide the panel in response to pivotal movement of the handle;

wherein the links include a first link fixed to the hub, a second link pivotally coupled to the first link, a third link pivotally coupled to the second link, and a fourth link pivotally coupled to the third link and the panel.

8. An apparatus as defined in claim 7, further comprising a hub supported for rotation about the orthogonal axis, and the linkage reaches from the hub to the panel.

9. An apparatus as defined in claim 8, wherein the cabinet has a door, and the handle is configured to rotate the hub about the orthogonal axis when the door is closed.

10. An apparatus as defined in claim 9, wherein the door has an aperture, and the handle is configured for releasable rotational coupling with the hub through the aperture in the door so as to rotate the hub about the orthogonal axis when the door is closed.

11. An apparatus as defined in claim 8, further comprising a frame in the cabinet, wherein the hub is mounted on the frame such that the orthogonal axis is fixed relative to the frame.

12. An apparatus as defined in claim 11, wherein the second link is coupled to the first link and the third link for movement pivotally about respective axes that are movable relative to the frame.

13. An apparatus as defined in claim 11, wherein the third link is mounted on the frame for movement pivotally about an axis that is fixed relative to the frame.

14. An apparatus as defined in claim 11, wherein the fourth link is coupled to the third link and the panel for movement pivotally about respective axes that are movable relative to the frame.

15. An apparatus comprising:

a cabinet;

a frame in the cabinet;

a pole unit in the cabinet, including an actuator shaft that is rotatable about a switch axis to switch the pole unit between open and closed conditions;

a hub mounted on the frame for rotation about an axis that is orthogonal to the switch axis and fixed relative to the frame;

a handle configured to rotate the hub;

a panel configured to rotate the actuator shaft upon sliding movement of the panel; and first, second, third, and fourth links coupled in series between the hub and the panel;

wherein the first link is fixed to the hub, the second link is coupled to the first link for movement pivotally about an axis that is movable relative to the frame, the third link is mounted on the frame for movement pivotally about an axis that is fixed relative to the frame, and the fourth link is coupled to the third link and the panel for movement pivotally about respective axes that are movable relative to the frame.

16. An apparatus as defined in claim 15, wherein the cabinet has a door, and the handle is configured to rotate the hub about the orthogonal axis when the door is closed.

17. An apparatus as defined in claim 16, wherein the door has an aperture, and the handle is configured for releasable rotational coupling with the hub through the aperture in the door so as to rotate the hub about the orthogonal axis when the door is closed.

18. An apparatus as defined in claim 15, wherein the switch axis is horizontal.

19. An apparatus as defined in claim 18, wherein the orthogonal axis is horizontal.

* * * * *